United States Patent [19]

Dambach et al.

[11] Patent Number: 4,538,874

[45] Date of Patent: Sep. 3, 1985

[54] MODULAR JACK ASSEMBLY

[75] Inventors: Philip J. Dambach, Naperville; B. Alan Berg, Wooddale, both of Ill.

[73] Assignee: Molex Incorporated, Lisle, Ill.

[21] Appl. No.: 644,146

[22] Filed: Aug. 24, 1984

Related U.S. Application Data

[63] Continuation of Ser. No. 382,392, May 27, 1982, abandoned.

[51] Int. Cl.[3] ..... H01R 11/20

[52] U.S. Cl. ..... 339/99 R; 339/97 P; 339/204

[58] Field of Search ..... 339/42 R, 43, 48, 44 R, 339/44 M, 49 B, 91 R, 244, 97 R, 98, 99 R, 97 P, 204, 205, 176 M, 176 MP

[56] References Cited

U.S. PATENT DOCUMENTS

| | | | |
|---|---|---|---|
| 3,835,445 | 9/1974 | Hardesty | 339/99 R |
| 3,950,063 | 4/1976 | Johansson | 339/97 R |
| 4,088,384 | 5/1978 | Gumb | 339/91 R |
| 4,186,988 | 2/1980 | Kobler | 339/176 MP |
| 4,195,898 | 4/1980 | Chow et al. | 339/99 R |
| 4,315,664 | 2/1982 | Hughes | 339/176 M |
| 4,335,929 | 6/1982 | Abernathy | 339/97 R |
| 4,392,701 | 7/1983 | Weidler | 339/97 R |
| 4,406,509 | 9/1983 | Jagen | 339/91 R |

*Primary Examiner*—William R. Briggs
*Attorney, Agent, or Firm*—Louis A. Hecht

[57] ABSTRACT

A modular telephone jack includes a receptacle housing with a first socket for receiving a modular telephone cord plug connector. A discrete jack contact connector is received in a second socket of the receptacle housing and establishes electrical connections with the modular plug. Terminals supported by the jack contact connector housing each include a spring contact portion exposed in the first socket for engagement by an inserted plug and an insulation displacement contact portion for convenient connection with various sizes and types of conductors used with the telephone jack. The housing of the jack contact connector is provided with an integrally hinged cover portion serving both to enclose the insulation displacement contact portions and to provide strain relief for the telephone jack conductors.

4 Claims, 6 Drawing Figures

MODULAR JACK ASSEMBLY

This application is a continuation of U.S. patent application Ser. No. 382,392, filed May 27, 1982 abandoned.

BACKGROUND OF THE INVENTION

1. Field of the Invention

This invention relates generally to modular jacks and particularly to such jacks useful in making connections in telephone systems.

2. Brief Description of the Prior Art

Modular jacks for use with telephones enable the telephone user to connect equipment such as a telephone head set and base to one another and to wall receptacles without the assistance of trained personnel. Telephone cords connectable between inhouse telephone jacks and a telephone base as well as telephone cords connectable between the head set and the base of a telephone are provided with modular connectors which are telescopically received within and removable from modular jacks of various types serving as receiving receptacles or sockets within the various telephone parts. These devices have facilitated the installation of the telephones and have gained widespread acceptance.

It is known in the art as disclosed in U.S. Pat No. 4,315,664 that receptacles for modular jacks may be provided with insulation displacing contacts located in the interior of the telephone parts so that internal wires can be connected through the insulation displacing contacts to a plug which is telescopically received within the socket. As pointed out in that patent, modular jacks are relatively small and space considerations present substantial problems in providing wire connecting means on modular jack terminals. In addition it is pointed out that when the wires are inserted into the wire receiving portions in a terminal housing, a substantial compressive force may be imposed on the housing and as a result of the wire receiving operation the modular jack housing may be damaged by the imposition of such forces.

In some applications it is desirable to connect different types or numbers of wires to the modular jack receptacle. With modular jacks, currently known, it is difficult to achieve interchangeability without using totally different receptacle housings or terminals for each application. Thus, either the housing might be provided with complicated, expensive electrical connection terminals which can receive a plurality wires of different diameter or a plurality of different housings must be kept in stock. Because of the desirability of low cost and small size modular jacks it is difficult to provide all these capabilities without using a variety of different receptacle housings.

SUMMARY OF THE INVENTION

It is, therefore, a principal object of the present invention to provide a modular electrical connector assembly capable of a high degree of interchangeability with respect to the number of wires, the size of the wires and the like, connectable by the assembly.

It is another object of the present invention to provide such an assembly made up of two parts one of which is telescopically receivable within the other.

It is still another object of the present invention to provide such an electrical assembly with an insulation displacement terminal on one of the parts together with a hinged strain relief member for ensuring the continued maintenance of the connection between one or more wires and the insulation displacement terminal.

In one form of the invention currently contemplated the modular jack for making an electrical connection with an electrical plug including at least one electrical contact includes a electrical receptacle housing with a first socket arranged to removably and telescopically receive the plug. A second socket is included in the housing and an insulation displacement connector has a housing that is telescopically receivable within the second socket. The connector includes an electrical terminal with a contact, within the housing, the contact including means for displacing the insulation from an insulation covered wire upon insertion of the wire into the terminal. The terminal also includes a spring contact electrically connected to the displacing means and arranged to make an electrical connection with a contact on the plug when both the plug and the connector are received within the receptacle housing.

DESCRIPTION OF THE PREFERRED EMBODIMENT

Figure 1:
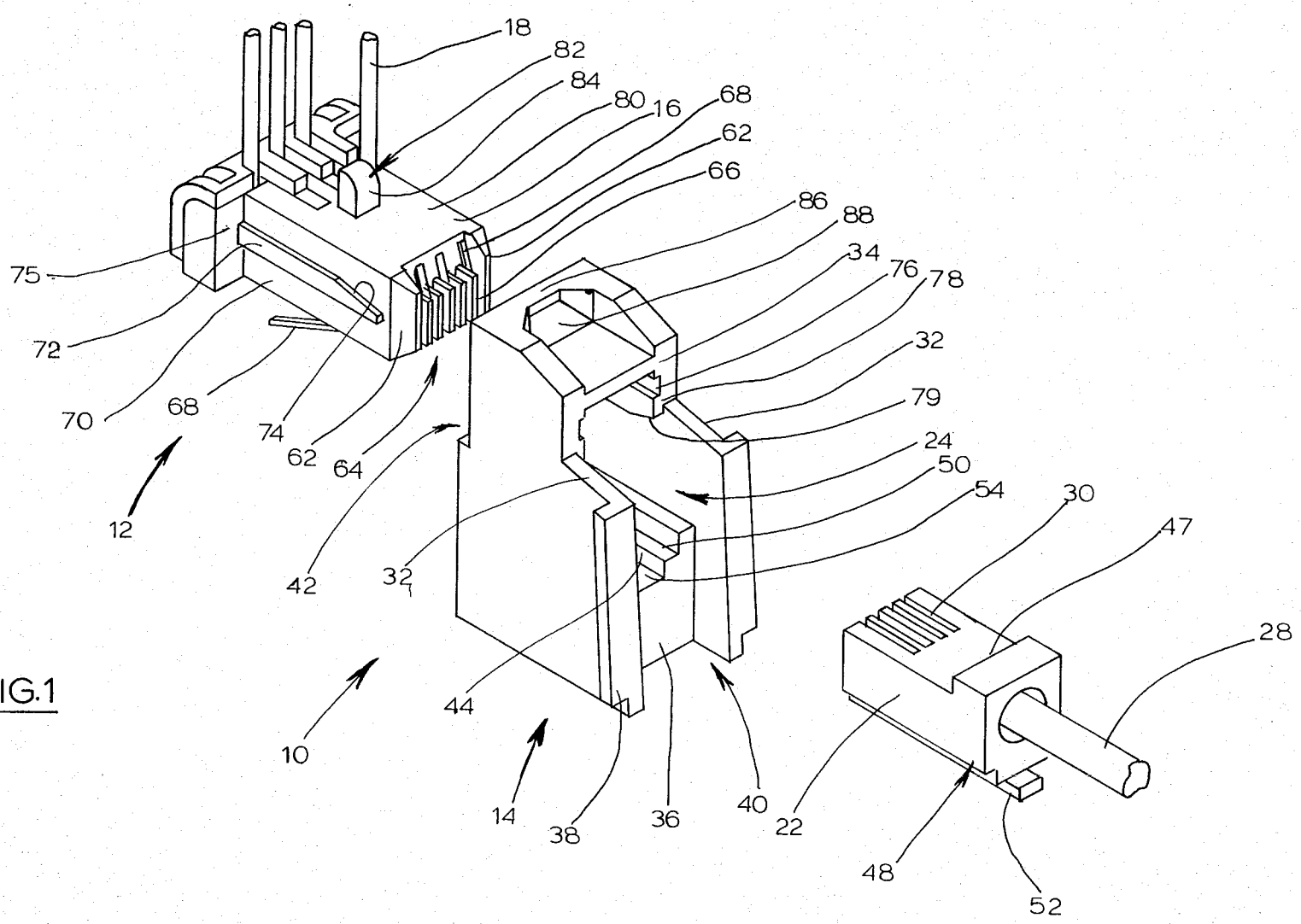
FIG. 1 is an exploded, perspective view of one embodiment of the modular jack of the present invention together with an electrical plug receivable within the jack.

Referring now to the figures, FIG. 1 illustrates a modular jack, generally designated 10, including an jack contact connector 12, and a receptacle housing 14. The connector 12 includes a housing 16 associated with a plurality of electrical wires 18. The housing 16 is telescopically receivable within a socket 20 of the receptacle housing 14. An electrical connector or plug 22 is telescopically receivable within a socket 24 in the housing 14. The plug 22 is conventional, having a housing 26 that receives an electrical cord 28 and a plurality of exposed electrical contact slots 30 having electrical contacts 31 located therein and connected electrically to the cord 28.

When the jack 10 is used in connection with a telephone, the cord 28 may connect the plug 22 to a wall receptacle or to another portion of the telephone such as the head set or telephone base as the case may be. Conveniently, the receptacle housing 14 and connector 12 are located within a housing of a telephone part such as a wall receptacle, a telephone base, or a head set. Jack receptacle housings including sockets 20 and 24 may be provided in various shapes and sizes depending upon the type of equipment with which the jack is used.

Figure 2:
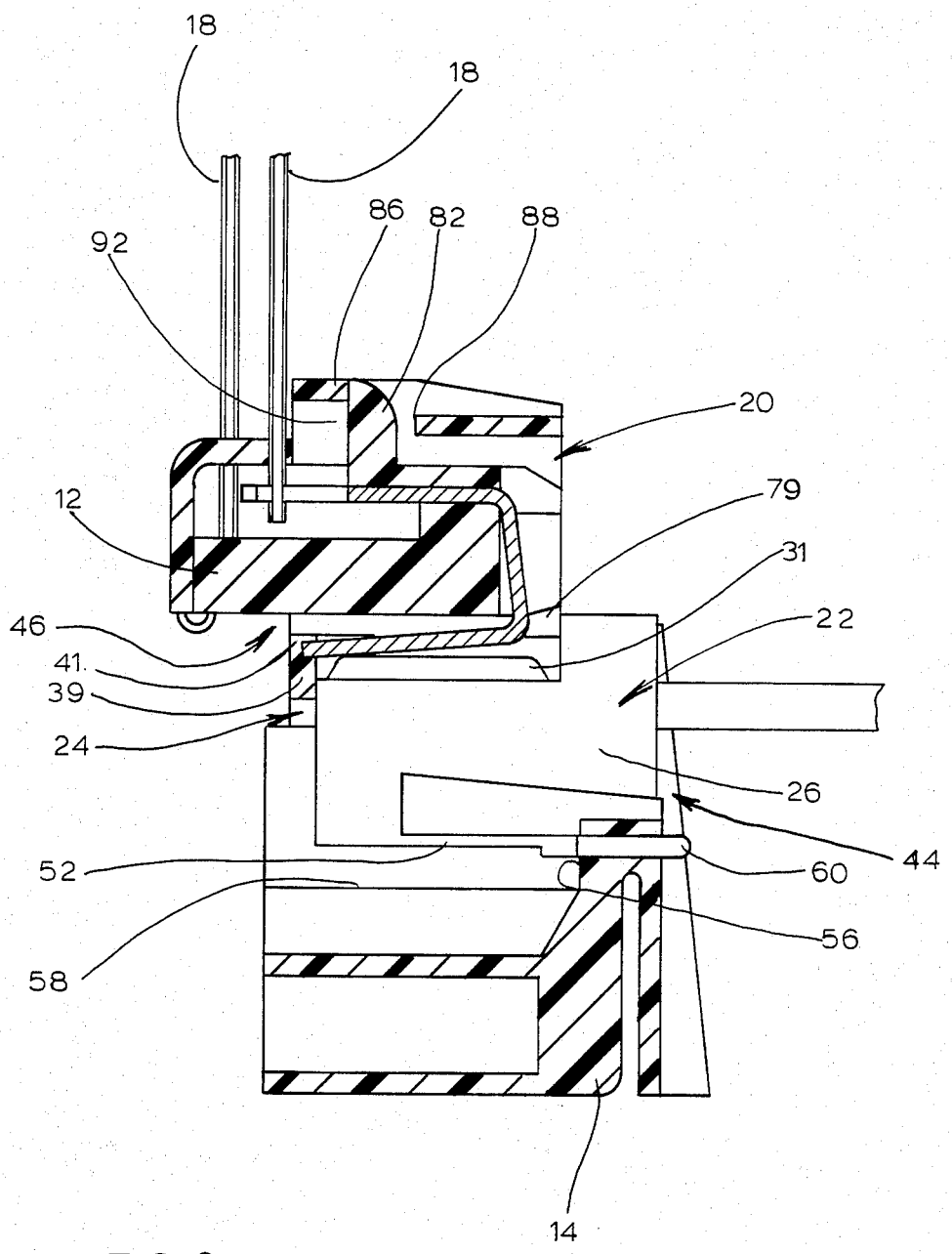
FIG. 2 is an enlarged cross-sectional view taken generally along the line 2—2 in FIG. 1, after the plug and connector have been inserted within the receptacle housing.

As shown in FIGS. 1 and 2, the housing 14 includes a pair of parallel side walls 32 connected by a top wall 34, a bottom wall 36, and a rear wall 41 with upwardly direced splines 39. An outwardly directed flange 38 on each wall 32 ensures the proper arrangement of the housing 14 with respect to a housing (not shown) in which it is inserted. Conveniently, the face 40 of the housing 14 faces outwardly from such a housing while the face 42 is directed inwardly of such a housing. The outward face 40 includes an opening 44 which defines the inlet to the socket 24 for the plug 22. Similarly, an opening 46 is defined on the rearward face 42 for access to the socket 20 which receives the connector 12. Thus, as shown in FIG. 2, the connector 12 and plug 22 are received in juxtaposed relationship, one atop the other, within the housing 14. Advantageously both the connector 12 and plug 22 are telescopically receivable within the housing 14, conventionally the plug 22 being removably locatable within its socket 24.

As shown in FIG. 1, the plug 22 includes an upstanding stop 47 and a stepped region 48 which keys with a mating stepped region 50 formed in the upper surface of the bottom wall 36. A catch 52 extends downwardly from the stepped region 48 and is received within a groove 54 in the bottom wall 36 of the housing 14, as shown in FIG. 2. A land 56 is formed at the end of the groove 54. In a conventional fashion the catch 52, which may be made of flexible material such as plastic, is adapted to be moved inwardly toward housing 26 upon insertion of the plug 22 into the housing 14, riding along the groove 54 until the catch 52 extends past the land 56 whereupon it springs downwardly into the region 58 of the bottom wall 36. A rearwardly extending prong 60, attached to the catch 52, may be upwardly actuated to free the catch 52 from the region 58. Preferably the distance between the side walls 32 corresponds rather closely to the width of the plug 22 so that positioning of the plug 22 within the socket 24 is achieved.

The housing 16 includes a pair of tapered forwardly extending tabs 62 on its forward end 64. The tabs 62 flank a plurality of spaced, outwardly extending, vertically arranged parallel plates 66 on the forward end 64. One or more flat terminals 68 with spring contacts 69 extend outwardly of the housing 16 and downwardly between a pair of adjacent plates 66 and then rearwardly under the housing 16, disposed at an acute angle with respect to the housing 16. In the illustrated embodiment, four such terminals 68 are illustrated, each extending between a different pair of plates 66. Each of the housing side walls 70 includes an outwardly extending guide 72 with a tapered leading end 74. The guides 72 are adapted to be received within grooves 76 on the inwardly facing side of each side wall 32 of the housing 14. The tapered leading end 74 of each guide 72 facilitates the initial positioning of the connector 12 with respect to the socket 20. Similarly, the tapered tabs 62 serve the same purpose in conjunction with the surfaces 78 extending outwardly with respect to the remainder of the side walls 32 that form the socket 20. A laterally extending surface 75 serves as stop, abutting against the housing 14 when the connector 12 is fully inserted.

The upper surface 80 of the housing 16 is punctuated by an upstanding tab 82 with a rounded leading edge 84. Upon insertion of the connector 12 into the socket 20, the tab 82, through its rounded edge 84, cams a socket bridge 86 upwardly until the tab 82 extends past the bridge 86 and extends into a notch 88 in the top wall 34 of the housing 14. Conveniently the bridge 86 as well as the remainder of the housing 14 is made of a flexible insulating material such as plastic. After complete insertion of the connector into the socket 20, the connector 12 is supported in the grooves 76, retained by the positioning of the tab 82 in the notch 88. While the connection between the connector 12 and the socket 20 is illustrated as an essentially permanent or non-removable connection, it may be desired to provide a removable or releasable connection between the connector 12 and the housing 14, and this may be accomplished in a conventional fashion, for example by rounding the rearwardly facing edge 92 of the tab 82.

The rearward end 94 of the connector 12 forms an insulation displacing connector region generally indicated as 96. A hinged strain relief cover 98 is connected to the housing 16 by a pair of hinges 100, conveniently integrally formed with the remainder of the connector 12 by plastic molding techniques. The cover 98 includes a plurality of transversely arranged, downwardly extending teeth 102 separated by troughs 104. In addition, a pair of spaced apart apertures 106 are formed in the cover 98 to mate with catches 108 on the end 94. The catches 108 are cam-shaped to facilitate a connection between the catches 108 and the apertures 106 while resisting opening of the cover 98 with respect to the housing 16. In this way the cover 98 may be pivoted from an open position, as shown in FIG. 4, to a closed position shown in FIG. 3, with its teeth 102 against the upper surface 80.

Figure 3:
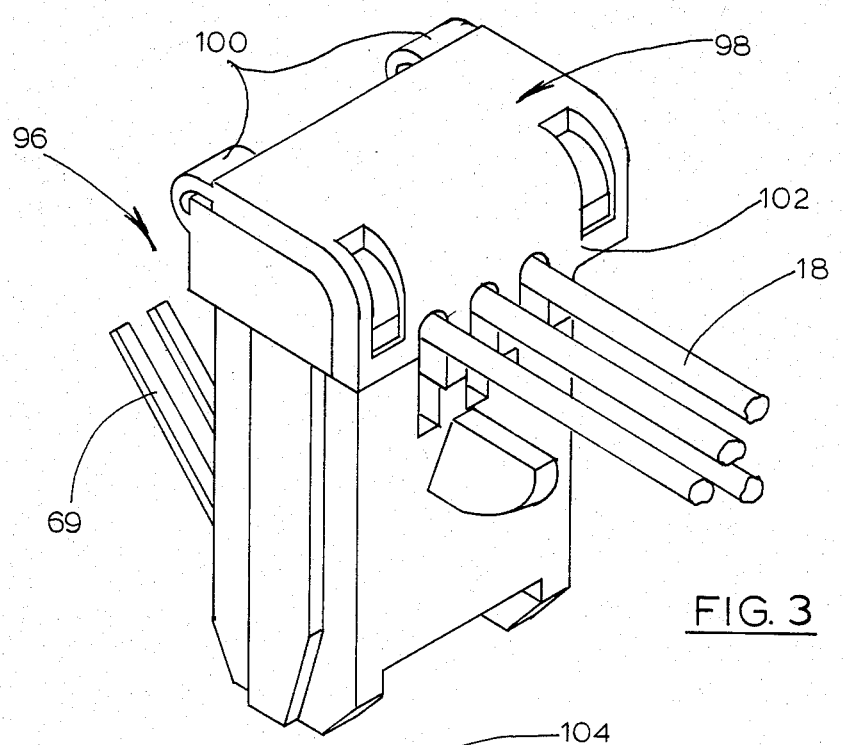
FIG. 3 is an enlarged perspective view of the connector in accordance with one embodiment of the present invention with the cover in its closed position.
Figure 4:
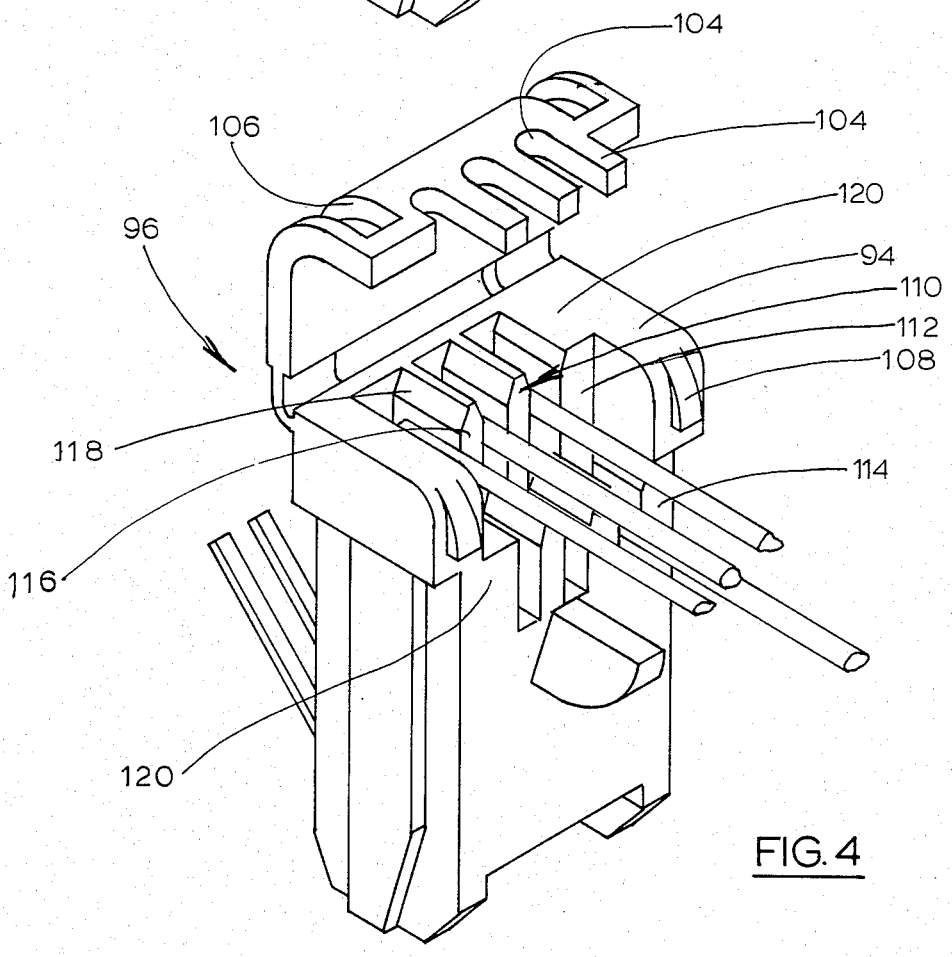
FIG. 4 is an enlarged perspective view of the embodiment shown in FIG. 3 with the cover in its open position.

When the cover 98 is in its open position, as shown in FIG. 4, a plurality of wire receiving receptacles 110 defined by upstanding tongues 116 with tapered upper ends 118 are exposed. In the illustrated embodiment, the receptacles 110 are arranged in an upper row 112 and a lower row 114. As shown in FIGS. 3 and 4, a plurality of insulation covered wires 18, arranged transversely to the housing 16, may be inserted into the connector 12 by positioning each wire 18 between a pair of adjacent tongues 116 or between a tongue 116 and an adjacent wall portion 120. Since the row 114 is positioned forwardly and below the row 112, one set of aligned wires 18 is positioned within the receptacles 110 forming the row 112 while another set of aligned wires may be positioned within the receptacles 110 forming the row 114. Different types of conductors such as wires of different sizes and separated end segments of flat or ribbon cable may be accommodated.

Figure 5:
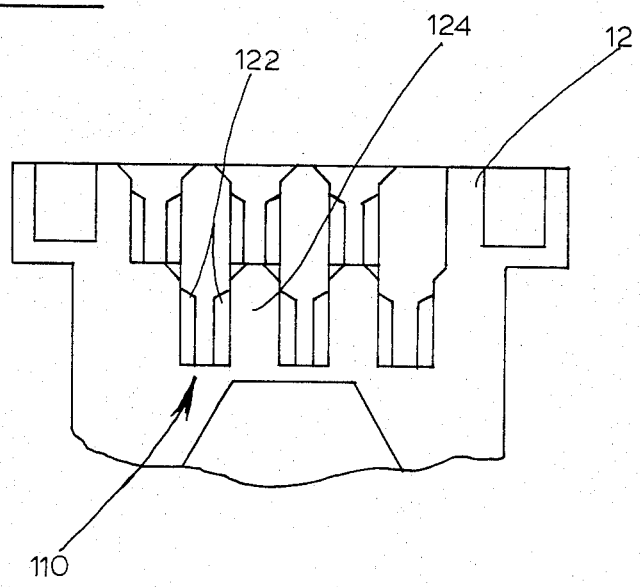
FIG. 5 is an enlarged partial, front elevational view of the connector, with the cover in its open position.
Figure 6:
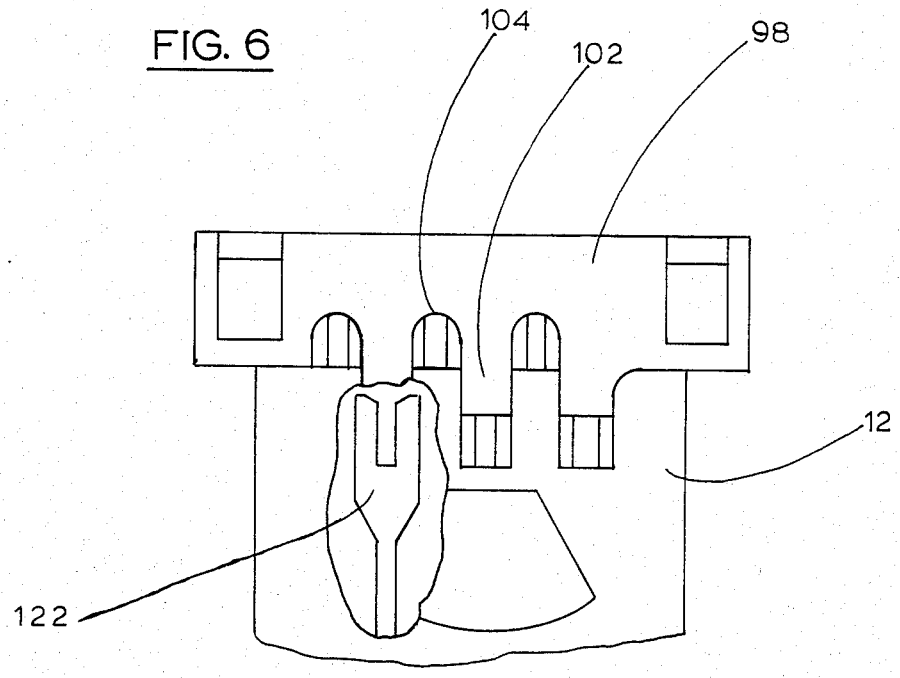
FIG. 6 is an enlarged, partial, front elevational view of the connector with the cover in its closed position.

As shown in FIGS. 5 and 6, each receptacle 110 includes a U-shaped insulation displacing contact 122. Preferably each U-shaped insulation displacing contact 122 is integral with one of the flat terminals 68, the contacts 122 forming one end thereof. As illustrated in FIG. 2, the terminals 68 extend through slots 123 in the housing 16 from each receptacle 110 through the forward end 64. Since the gap 124 formed between the prongs of a U-shaped insulation displacement contact 122 is less than the thickness of the wire conductor of 18, the wires have their insulation automatically displaced upon insertion into the gap 124, establishing an electrical connection between the the wires 18 and the contacts 122.

As shown in FIG. 6, after the wires 18 have been positioned in the appropriate receptacles 110, the cover 98 may be closed, securing the wires 18 within the desired receptacles 110 and preventing their inadvertent loosening or removal. Since the teeth 102 of the cover 98 are each aligned with the receptacles 110 forming the lower row 114, and since the troughs 104 are aligned with the receptacles 110 forming the upper row 112, the cover 98 is able to retain all inserted wires 18 within the desired receptacles 110. Specifically the teeth 102 are positioned adjacent the upper surface of the wires 18 in the lower row 114 while the troughs 104 are adjacent the upper surface of the wires 18 in the upper row 112.

The modular jack 10 may be utilized in the following manner. With the cover 98 in its open position one or more wires 18 are inserted within the appropriate receptacles 110, and the wires are forced inwardly into the receptacles 110 by moving the wires toward the forward end 64 in a direction transverse to their length so that they extend generally transversely away from the connector 12. In the process of insertion, the insulation covering of the wires 18 is automatically displaced. In this way an electrical connection is established between the wires 18 and the terminal 68 which extends from the forward end 64 of the housing 16 and then downwardly beneath the housing 16.

The cover 98 is then closed and latched, through the catches 108, atop the desired number of wires 18 to secure them within the receptacles 110. Regardless of whether all the receptacles 110 are filled, the cover 98 secures the wires in the desired receptacles 110. Because of the offset nature of the upper row 112 with respect to the lower row 114, all the terminals 68 which extend beneath the housing 16 are offset laterally with respect to one another. Due to the fact that the terminals 68 are wrapped about an edge of the forward end 64, the spring contacts 69 all lie in the same plane.

The connector 12 is then telescopically inserted into the receptacle 20, the spring contacts 69 passing through the aligned slots in the rear wall 41. The tapered leading edge of the tabs 62 and the guide 72 precisely position the connector 12 within the housing 14. When the connector 12 is fully positioned within the socket 20, the tab 82 snaps into the notch 88 securing the connector therein. As shown in FIG. 2, while the connector 12 rests in the socket 20 of the housing 14, each terminal 68 is maintained within a slot between the splines 39 of the comb-shaped rear wall 41 to maintain the separation of the various terminals 68 with respect to another and to ensure their proper lateral alignment. The receptacle 20 is mounted on equipment such as a telephone base, headset, wall receptacle, etc. to which a connection is to be made by means of cord 28.

The plug 22 may then be telescopically inserted into the socket 24 of the housing 14, the stepped region 48 of the plug 22 interacting with the stepped region 50 of the housing 14 to guide the keyed positioning of the plug within the socket 14. In addition the lower edges of the surfaces 78 maintain the plug 22 in contact with the region 50, and the notches 79 in the surfaces 78 guide the initial positioning of the plug 22 in its socket 24. When the plug 22 is fully positioned within the socket 24, the stop 47 being positioned against the surfaces 78, the catch 52 snaps behind the land 56 securing the plug 22 removably within the socket 24.

As the plug 22 moves into the socket 14, the terminals 68 are automatically located within the exposed electrical contact slots 30 on the plug 22 and spring biased against the plug contacts 31. This enables the terminals 68 to make an electrical connection with the corresponding contact 31 located within each slot 30. In this way the desired wires 18 as determined by the specific receptacle 110 in which they are positioned, can be electrically connected to the appropriate contacts on the plug 22.

If after positioning the plug 22 within the housing 14 it is desired to remove the plug 22, it is only necessary to lift upwardly on the prong 60 and to withdraw the plug 22 from the housing 14. Thereafter a different plug 22 may be inserted within the receptacle 24.

Due to the fact that the jack contact connector 12 is separate and discrete from the jack receptacle housing 14, the advantages of versatility and unit cost reduction associated with a modular system are achieved. For example, the jack contact connector 12 can be used with various sizes and types of receptacle housings adapted to be mounted on different types of telephone equipment. Moreover, the jack contact connector 12 can be replaced without replacement of the entire receptacle housing 14 in the event of damage during wire insertion or the like.

We claim:

1. An electrical jack assembly adapted to electrically mate with an electrical plug which has a plurality of electrical plug contacts mounted therein, said jack assembly including a receptacle housing having a forward plug-receiving end and a rearward end, said housing further having a first socket portion with a plug-receiving opening extending into the forward end arranged to removably and telescopically receive said plug, said receptacle housing further having a second socket portion adjacent the first socket portion with a jack contact connector opening extending into the rearward end, a discrete jack contact connector adapted to be removably and telescopically received through said jack connector opening into said second socket portion, said connector having a connector housing with a plurality of wire receiving receptacles formed therein and plurality of jack contacts having spring portions adapted to electrically engage said plug contacts when both the jack contact connector and plug are received in said receptacle housing, said jack contacts each having a wire mating portion disposed in a wire receiving receptacle and adapted to electrically contact an insulated wire conductor received in said wire receptacle, the improvement in said jack contact connector comprising:

said wire receptacles are arranged in two rows so that every other receptacle is in a different row, each of said two rows lying in planes which are offset from each other, forming a staggered configuration which is staggered in two dimensions;

said wire mating portion having an insulation displacement slot adapted to slice through the insulation of the wire to touch the conductor;

a hinged cover integrally formed with said connector housing and including strain relief means extending toward the electrically connected wires, said cover being moveable between an initial open position and a closed position wherein said strain relief means traps said wires and serves to prevent accidental withdrawal of the wires from the insulation displacement slots of their respective jack contacts.

2. An electrical jack assembly adapted to electrically mate with an electrical plug which has a plurality of electrical plug contacts mounted therein, said jack assembly including a receptacle housing having a forward plug-receiving end and a rearward end, said housing further having a first socket portion with a plug-receiving opening extending into the forward end arranged to removably and telescopically receive said plug, said receptacle housing further having a second socket portion adjacent the first socket portion with a jack contact connector opening extending into the rearward end, a discrete jack contact connector adapted to be removably and telescopically received through said jack connector opening into said second socket portion, said connector having a connector housing with a plurality of wire receiving receptacles formed therein and plurality of jack contacts having spring portions adapted to electrically engage said plug contacts when both the jack contact connector and plug are received in said receptacle housing, said jack contacts each having a wire mating portion disposed in a wire receiving receptacle and adapted to electrically contact an insulated wire conductor received in said wire receptacle, the improvement in said jack contact connector comprising:

said wire receptacles arranged in two rows so that every other wire receptacle is in a different row, thereby defining a staggered configuration;

said wire mating portion having an insulation displacement slot adapted to slice through the insulation of the wire to touch the conductor;

a hinged cover integrally formed with said connector housing and including strain relief means extending toward the electrically connected wires, said strain relief means including first means for securing wires within the first row of wire receptacles and second means for securing wires within said second row of wire receptacles, said cover being moveable between an initial open position and a closed position wherein said strain relief means traps said wires and serves to prevent accidental withdrawal of the wires from the insulation displacement slots of their respective jack contacts.

3. The jack assembly 2 wherein said receptacles are defined by a pair of adjacent upstanding members, said wire positionable between said members, said insulation displacing contact in each wire receptacle being U-shaped, an insulation displacing contact being maintained between each pair of said members and defining a gap for receiving said wire.

4. The jack assembly of claim 2 said second means including a set of outwardly extending teeth secured to said cover and said first means including a plurality of troughs defined between each pair of adjacent teeth.

* * * * *